US007913765B2

(12) United States Patent
Crow et al.

(10) Patent No.: US 7,913,765 B2
(45) Date of Patent: Mar. 29, 2011

(54) WATER ABSORBING OR DISSOLVING MATERIALS USED AS AN IN-FLOW CONTROL DEVICE AND METHOD OF USE

(75) Inventors: Stephen L. Crow, Kingwood, TX (US); Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 370 days.

(21) Appl. No.: 11/875,606

(22) Filed: Oct. 19, 2007

(65) Prior Publication Data

US 2009/0101353 A1 Apr. 23, 2009

(51) Int. Cl.
*E21B 34/06* (2006.01)

(52) U.S. Cl. ..... 166/373; 166/376; 166/386; 166/317; 166/320

(58) Field of Classification Search ..... 166/250.03, 166/373, 376, 386, 317, 320, 205.15, 54; 137/67.11, 78.1; 251/1.1–1.3, 11
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,412,841 | A | 12/1946 | Spangler |
| 2,762,437 | A | 9/1956 | Egan et al. |

(Continued)

FOREIGN PATENT DOCUMENTS

| | | |
|---|---|---|
| CN | 1385594 | 12/2002 |
| GB | 1492345 | 11/1977 |
| GB | 2341405 | 12/2007 |
| JP | 59089383 B2 | 5/1984 |
| SU | 1335677 A | 9/1987 |
| WO | 9403743 A1 | 2/1994 |
| WO | WO 00/79097 | 5/2000 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Daniel P Stephenson
*Assistant Examiner* — Cathleen R Hutchins
(74) *Attorney, Agent, or Firm* — Mossman, Kumar & Tyler, PC

(57) ABSTRACT

A device or system for controlling fluid flow in a well includes a flow restriction member that transitions from a first effective density to a second effective density in response to a change in composition of the flowing fluid. The flow restriction member may increase in effective density as the water cut of the flowing fluid increases and/or disintegrate when exposed to a selected fluid in the flowing fluid. The flow restriction member may be formed of a water-absorbing material and/or a porous material. The pores may be water permeable but not oil permeable. A method for producing fluid from a subterranean formation includes controlling a flow of fluid into a wellbore tubular with a flow restriction member. The method may include reducing a flow of water into the wellbore tubular when a percentage of water in the flowing fluid reaches a predetermined value.

20 Claims, 5 Drawing Sheets

U.S. PATENT DOCUMENTS

| | | | |
|---|---|---|---|
| 2,810,352 | A | 10/1957 | Tumilson |
| 2,814,947 | A | 12/1957 | Stegemeier et al. |
| 2,942,668 | A | 6/1960 | Maly et al. |
| 2,945,541 | A | 7/1960 | Maly et al. |
| 3,326,291 | A | 6/1967 | Zandmer |
| 3,385,367 | A | 5/1968 | Kollsman |
| 3,419,089 | A | 12/1968 | Venghiattis |
| 3,451,477 | A | 6/1969 | Kelley |
| 3,675,714 | A | 7/1972 | Thompson |
| 3,692,064 | A | 9/1972 | Hohnerlein et al. |
| 3,739,845 | A | 6/1973 | Berry et al. |
| 3,791,444 | A | 2/1974 | Hickey |
| 3,876,471 | A | 4/1975 | Jones |
| 3,918,523 | A | 11/1975 | Stuber |
| 3,951,338 | A | 4/1976 | Genna |
| 3,975,651 | A | 8/1976 | Griffiths |
| 4,153,757 | A | 5/1979 | Clark |
| 4,173,255 | A | 11/1979 | Kramer |
| 4,180,132 | A | 12/1979 | Young |
| 4,186,100 | A | 1/1980 | Mott |
| 4,187,909 | A | 2/1980 | Erbsoesser |
| 4,248,302 | A | 2/1981 | Churchman |
| 4,250,907 | A | 2/1981 | Struckman et al. |
| 4,257,650 | A | 3/1981 | Allen |
| 4,287,952 | A | 9/1981 | Erbstoesser |
| 4,415,205 | A | 11/1983 | Rehm et al. |
| 4,434,849 | A | 3/1984 | Allen |
| 4,491,186 | A | 1/1985 | Alder |
| 4,497,714 | A | 2/1985 | Harris |
| 4,552,218 | A | 11/1985 | Ross et al. |
| 4,572,295 | A | 2/1986 | Walley |
| 4,614,303 | A | 9/1986 | Moseley, Jr. et al. |
| 4,649,996 | A | 3/1987 | Kojicic et al. |
| 4,821,800 | A | 4/1989 | Scott et al. |
| 4,856,590 | A | 8/1989 | Caillier |
| 4,917,183 | A | 4/1990 | Gaidry et al. |
| 4,944,349 | A | 7/1990 | Von Gonten, Jr. |
| 4,974,674 | A | 12/1990 | Wells |
| 4,998,585 | A | 3/1991 | Newcomer et al. |
| 5,004,049 | A | 4/1991 | Arterbury |
| 5,016,710 | A | 5/1991 | Renard et al. |
| 5,132,903 | A | 7/1992 | Sinclair |
| 5,156,811 | A | 10/1992 | White |
| 5,333,684 | A | 8/1994 | Walter et al. |
| 5,337,821 | A | 8/1994 | Peterson |
| 5,339,895 | A | 8/1994 | Arterbury et al. |
| 5,377,750 | A | 1/1995 | Arterbury et al. |
| 5,381,864 | A | 1/1995 | Nguyen et al. |
| 5,431,346 | A | 7/1995 | Sinaisky |
| 5,435,393 | A | 7/1995 | Brekke et al. |
| 5,435,395 | A | 7/1995 | Connell |
| 5,439,966 | A | 8/1995 | Graham et al. |
| 5,551,513 | A | 9/1996 | Surles et al. |
| 5,586,213 | A | 12/1996 | Bridges et al. |
| 5,597,042 | A | 1/1997 | Tubel et al. |
| 5,609,204 | A | 3/1997 | Rebardi et al. |
| 5,673,751 | A | 10/1997 | Head et al. |
| 5,803,179 | A | 9/1998 | Echols |
| 5,829,522 | A | 11/1998 | Ross et al. |
| 5,831,156 | A | 11/1998 | Mullins |
| 5,839,508 | A | 11/1998 | Tubel et al. |
| 5,873,410 | A | 2/1999 | Iato et al. |
| 5,881,809 | A | 3/1999 | Gillespie et al. |
| 5,896,928 | A | 4/1999 | Coon |
| 5,982,801 | A | 11/1999 | Deak |
| 6,068,015 | A | 5/2000 | Pringle |
| 6,098,020 | A | 8/2000 | Den Boer |
| 6,112,815 | A | 9/2000 | Boe et al. |
| 6,112,817 | A | 9/2000 | Voll |
| 6,119,780 | A | 9/2000 | Christmas |
| 6,228,812 | B1 | 5/2001 | Dawson et al. |
| 6,253,847 | B1 | 7/2001 | Stephenson |
| 6,253,861 | B1 | 7/2001 | Carmichael et al. |
| 6,273,194 | B1 | 8/2001 | Hiron |
| 6,305,470 | B1 | 10/2001 | Woie |
| 6,338,363 | B1 | 1/2002 | Chen et al. |
| 6,367,547 | B1 | 4/2002 | Towers et al. |
| 6,371,210 | B1 | 4/2002 | Bode et al. |
| 6,372,678 | B1 | 4/2002 | Youngman et al. |
| 6,419,021 | B1 | 7/2002 | George et al. |
| 6,474,413 | B1 | 11/2002 | Barbosa et al. |
| 6,505,682 | B2 | 1/2003 | Brockman |
| 6,516,888 | B1 | 2/2003 | Gunnerson et al. |
| 6,581,681 | B1 | 6/2003 | Zimmerman et al. |
| 6,581,682 | B1 | 6/2003 | Parent et al. |
| 6,622,794 | B2 | 9/2003 | Zisk |
| 6,632,527 | B1 | 10/2003 | McDaniel et al. |
| 6,635,732 | B2 | 10/2003 | Mentak |
| 6,667,029 | B2 | 12/2003 | Zhong et al. |
| 6,679,324 | B2 | 1/2004 | Boer et al. |
| 6,692,766 | B1 | 2/2004 | Rubinstein et al. |
| 6,699,503 | B1 | 3/2004 | Sako et al. |
| 6,699,611 | B2 | 3/2004 | Kim et al. |
| 6,786,285 | B2 | 9/2004 | Johnson et al. |
| 6,817,416 | B2 | 11/2004 | Wilson et al. |
| 6,840,321 | B2 | 1/2005 | Restarick et al. |
| 6,857,476 | B2 | 2/2005 | Richards |
| 6,863,126 | B2 | 3/2005 | McGlothen et al. |
| 6,938,698 | B2 | 9/2005 | Coronado |
| 6,951,252 | B2 | 10/2005 | Restarick et al. |
| 6,976,542 | B2 | 12/2005 | Henriksen et al. |
| 7,011,076 | B1 | 3/2006 | Weldon et al. |
| 7,084,094 | B2 | 8/2006 | Gunn et al. |
| 7,159,656 | B2 | 1/2007 | Eoff et al. |
| 7,185,706 | B2 | 3/2007 | Freyer |
| 7,290,606 | B2 | 11/2007 | Coronado et al. |
| 7,318,472 | B2 | 1/2008 | Smith |
| 7,322,412 | B2 | 1/2008 | Badalamenti et al. |
| 7,325,616 | B2 | 2/2008 | Lopez de Cardenas et al. |
| 7,395,858 | B2 | 7/2008 | Barbosa et al. |
| 7,409,999 | B2 | 8/2008 | Henriksen et al. |
| 7,469,743 | B2 | 12/2008 | Richards |
| 7,673,678 | B2 | 3/2010 | MacDougall et al. |
| 2002/0020527 | A1 | 2/2002 | Kilaas et al. |
| 2002/0125009 | A1 | 9/2002 | Wetzel et al. |
| 2003/0221834 | A1 | 12/2003 | Hess et al. |
| 2004/0052689 | A1 | 3/2004 | Yao |
| 2004/0144544 | A1 | 7/2004 | Freyer |
| 2004/0194971 | A1 | 10/2004 | Thomson |
| 2005/0016732 | A1 | 1/2005 | Brannon et al. |
| 2005/0126776 | A1 | 6/2005 | Russell |
| 2005/0171248 | A1 | 8/2005 | Li et al. |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2006/0042798 | A1* | 3/2006 | Badalamenti et al. ..... 166/285 |
| 2006/0048936 | A1 | 3/2006 | Fripp et al. |
| 2006/0048942 | A1 | 3/2006 | Moen et al. |
| 2006/0076150 | A1 | 4/2006 | Coronado . |
| 2006/0086498 | A1 | 4/2006 | Wetzel et al. |
| 2006/0108114 | A1 | 5/2006 | Johnson |
| 2006/0175065 | A1 | 8/2006 | Ross |
| 2006/0185849 | A1 | 8/2006 | Edwards et al. |
| 2006/0272814 | A1 | 12/2006 | Broome et al. |
| 2007/0012444 | A1 | 1/2007 | Horgan et al. |
| 2007/0039741 | A1 | 2/2007 | Hailey |
| 2007/0044962 | A1 | 3/2007 | Tibbles |
| 2007/0131434 | A1 | 6/2007 | MacDougall et al. |
| 2007/0246210 | A1 | 10/2007 | Richards |
| 2007/0246213 | A1* | 10/2007 | Hailey ..... 166/278 |
| 2007/0246225 | A1* | 10/2007 | Hailey et al. ..... 166/386 |
| 2007/0246407 | A1 | 10/2007 | Richards et al. |
| 2007/0272408 | A1 | 11/2007 | Zazovsky et al. |
| 2008/0035349 | A1 | 2/2008 | Richard |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0236839 | A1 | 10/2008 | Oddie |
| 2008/0236843 | A1 | 10/2008 | Scott et al. |
| 2008/0283238 | A1* | 11/2008 | Richards et al. ..... 166/228 |
| 2008/0296023 | A1 | 12/2008 | Willauer |
| 2008/0314590 | A1 | 12/2008 | Patel |
| 2009/0056816 | A1 | 3/2009 | Arov et al. |

| | | | |
|---|---|---|---|
| 2009/0133869 | A1 | 5/2009 | Clem |
| 2009/0133874 | A1 | 5/2009 | Dale et al. |
| 2009/0139727 | A1 | 6/2009 | Tanju et al. |
| 2009/0205834 | A1 | 8/2009 | Garcia et al. |

FOREIGN PATENT DOCUMENTS

| | | |
|---|---|---|
| WO | WO 01/65063 | 2/2001 |
| WO | WO 01/77485 | 3/2001 |
| WO | WO 02/075110 | 9/2002 |
| WO | 2004018833 A1 | 3/2004 |
| WO | WO 2006/015277 | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Dikken, Ben J.; SPE, Knojinklijke/Shell E&P Laboratorium; Pressure Drop I Horizontal Wells and Its Effect On Production Performance; JPT, Nov. 1990; Presented 1989 SPE Annual Technical Conference and Exhibition San Antonio, Oct. 8-11; Copyright 1980 Society of Petroleum Engineers.

Restarick, Henry, Halliburton Energy Services; SPE 29831, Horizontal Completion Options In Reservoirs With Sand Problems; Presented at the SPE Middle East Oil Show in Bahrain, Mar. 11-14, 1995; Copyright 1995, Society of Petroleum Engineers.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M B., 2002, 43(1) 5181-5186.

"Thermoreversible Swelling Behavior of Hydrogels Based on N-Isopropylacrylamide with a Zwitterionic Comonomer", Xue, W., Champ. S. amd Huglin, M. B. 2001, European Polymer Journal, 37(5) 869-875.

Dinarvand, R., D'Emanuele, A (1995) The use of thermoresponsive hydrogels for on-off release of molecules, J Control. Rel. 36: 221-227.

Tanaka, T., Nishio, I., Sun, S.T., Ueno-Nishio, S. (1982) Collapse of gels in an electric field, Science. 218:467-469.

Ishihara,K., Hamada, N., Sato, S., Shinohara, I., (1984) Photoinduced serlling control of amphiphdilic azoaromatic polymer membrane. J Polym. Sci., Polym. Chem. Ed 22: 121-128.

Ricka, J. Tanaka, T. (1984) Swelling of Ionic gels: Quantitative performance of the Donnan Thory, Macromolecules, 17: 2916-2921.

Stephen P. Mathis, Baker Oil Tools,.SPE; "Sand Management: A Review of Approaches and Concerns; SPE 82240"; Presented at the SPE European Formation Damage Conference, Hague, The Netherlands, May 13-14, 2003: Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control New Orleans, LA., Feb. 7-8, 1974; Copyright 1974, American Institute of Mining, Metallurgical and Petroleum Engineers, Inc.

* cited by examiner

WATER ABSORBING OR DISSOLVING MATERIALS USED AS AN IN-FLOW CONTROL DEVICE AND METHOD OF USE

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides an apparatus for controlling flow of a fluid into a tubular in a wellbore drilled into an earthen formation. In one embodiment, the apparatus includes a flow restriction member positioned along the wellbore tubular that transitions from a first effective density to a second effective density in response to a change in composition of the flowing fluid. In one arrangement, the first effective density is less than the second effective density. In aspects, the flow restriction member may be configured to increase in effective density as a percentage of water in the flowing fluid increases. In embodiments, the flow restriction member may be formed of a water-absorbing material that causes the flow restriction member to increase in density as water is absorbed into a portion of the flow restriction member. The flow restriction member may be formed at least partially of a material that has pores. In aspects, the pores are water permeable but not oil permeable. In another embodiment, the flow restriction member may be formed at least partially of a material that is calibrated to disintegrate when exposed to a selected fluid in the flowing fluid.

In aspects, the present disclosure provides a method for producing fluid from a subterranean formation. In one embodiment, the method includes controlling a flow of fluid into a wellbore tubular with a flow restriction member. The flow restriction member is configured to transition from a first effective density to a second effective density in response to a change in composition of the flowing fluid. In aspects, the method may include reducing a flow of water into the wellbore tubular when a percentage of water in the flowing fluid reaches a predetermined value. The method may also include increasing the density of the flow restriction member by absorbing water into the flow restriction member.

In aspects, the present disclosure provides a system for controlling a flow of a fluid in a well. The system may include a wellbore tubular positioned in the well and one or more flow restriction members positioned along the wellbore tubular. One or more of these flow restriction members may be configured to transition from a first effective density to a second effective density in response to a change in composition of the flowing fluid. In embodiments, a plurality of flow restriction members are distributed along the wellbore tubular. In aspects, the flow restriction member may be configured to decrease the flow of the fluid in the wellbore tubular when a percentage of water in the flowing fluid reaches a predetermined value.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
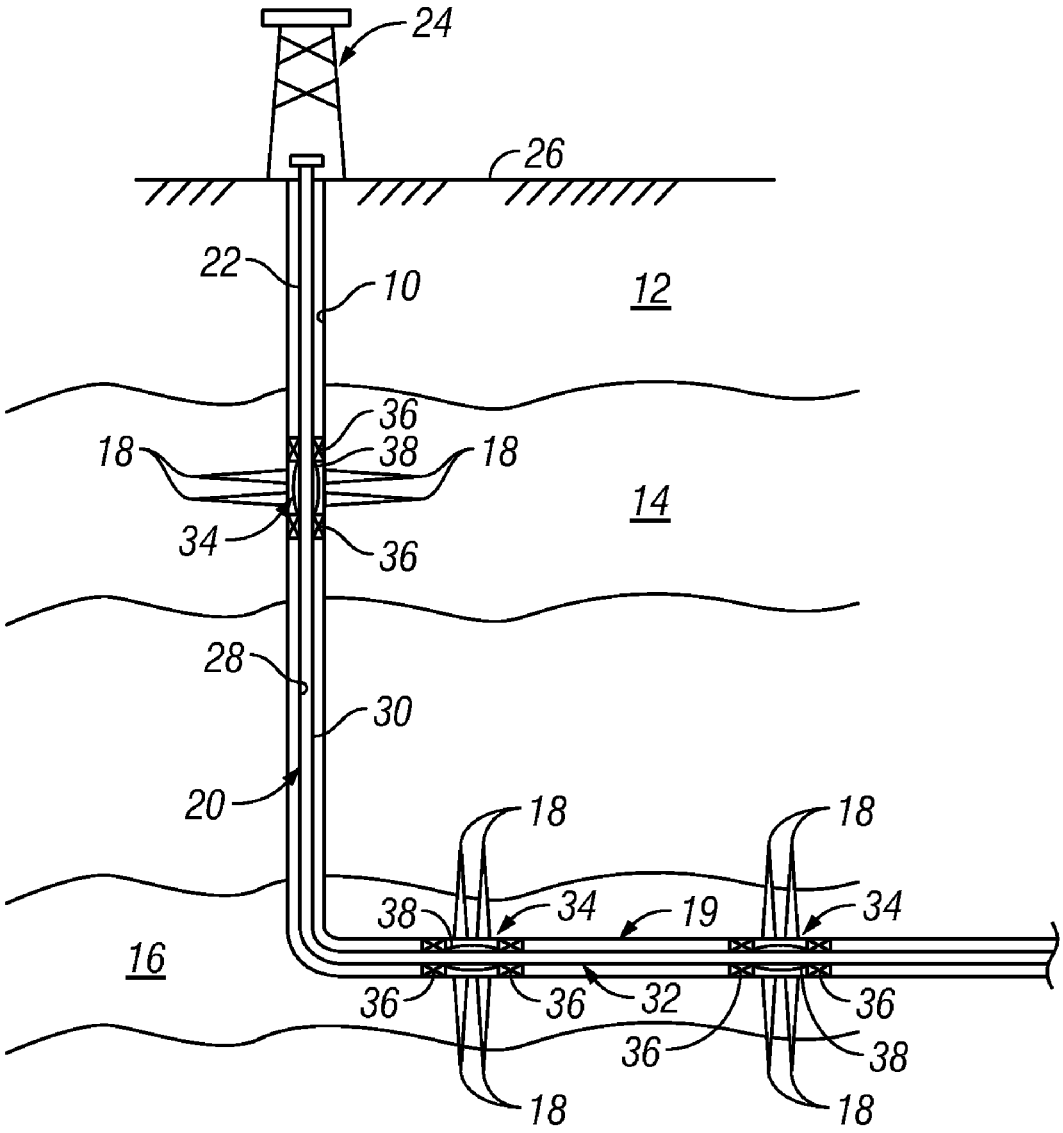
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
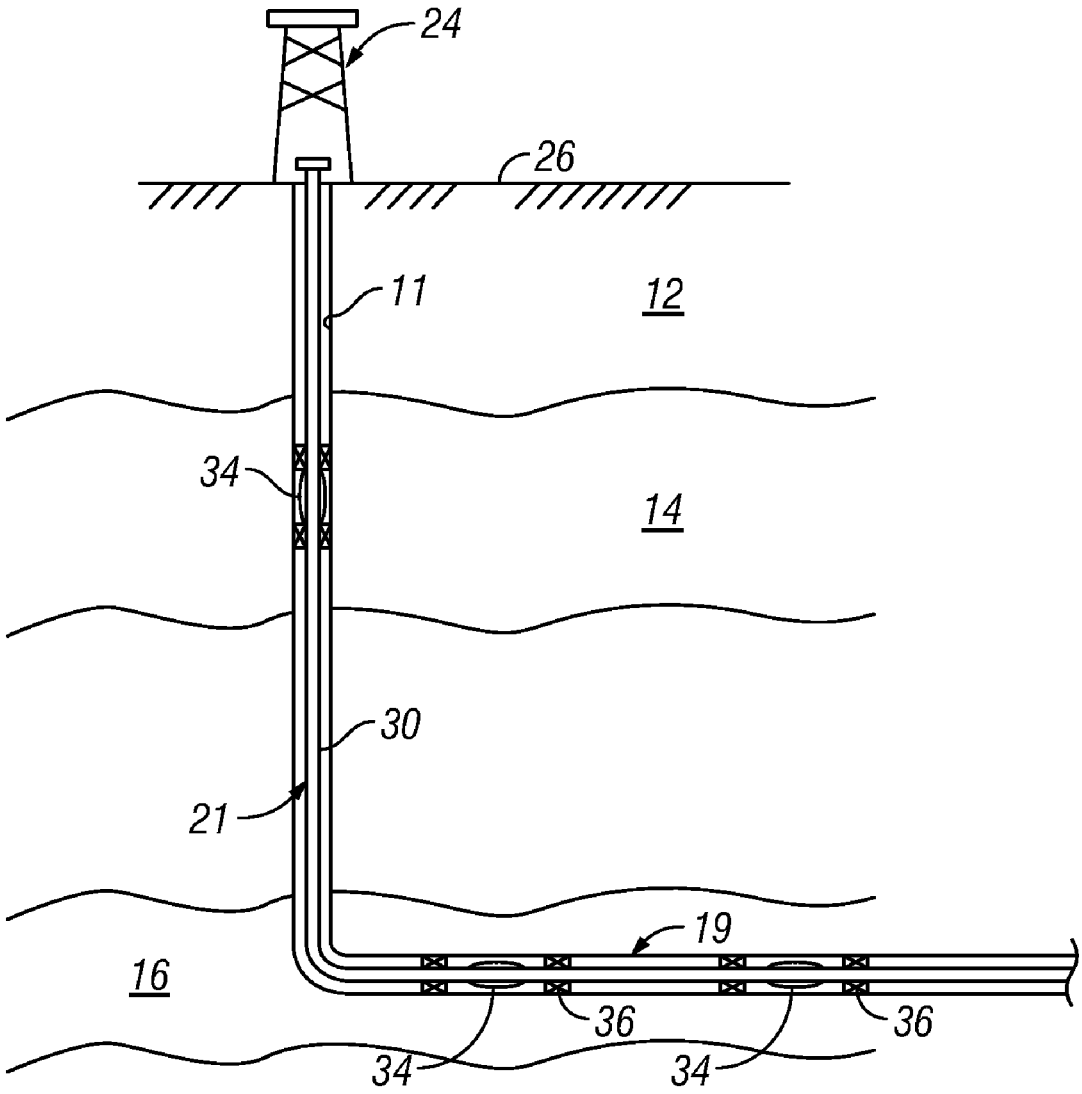
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
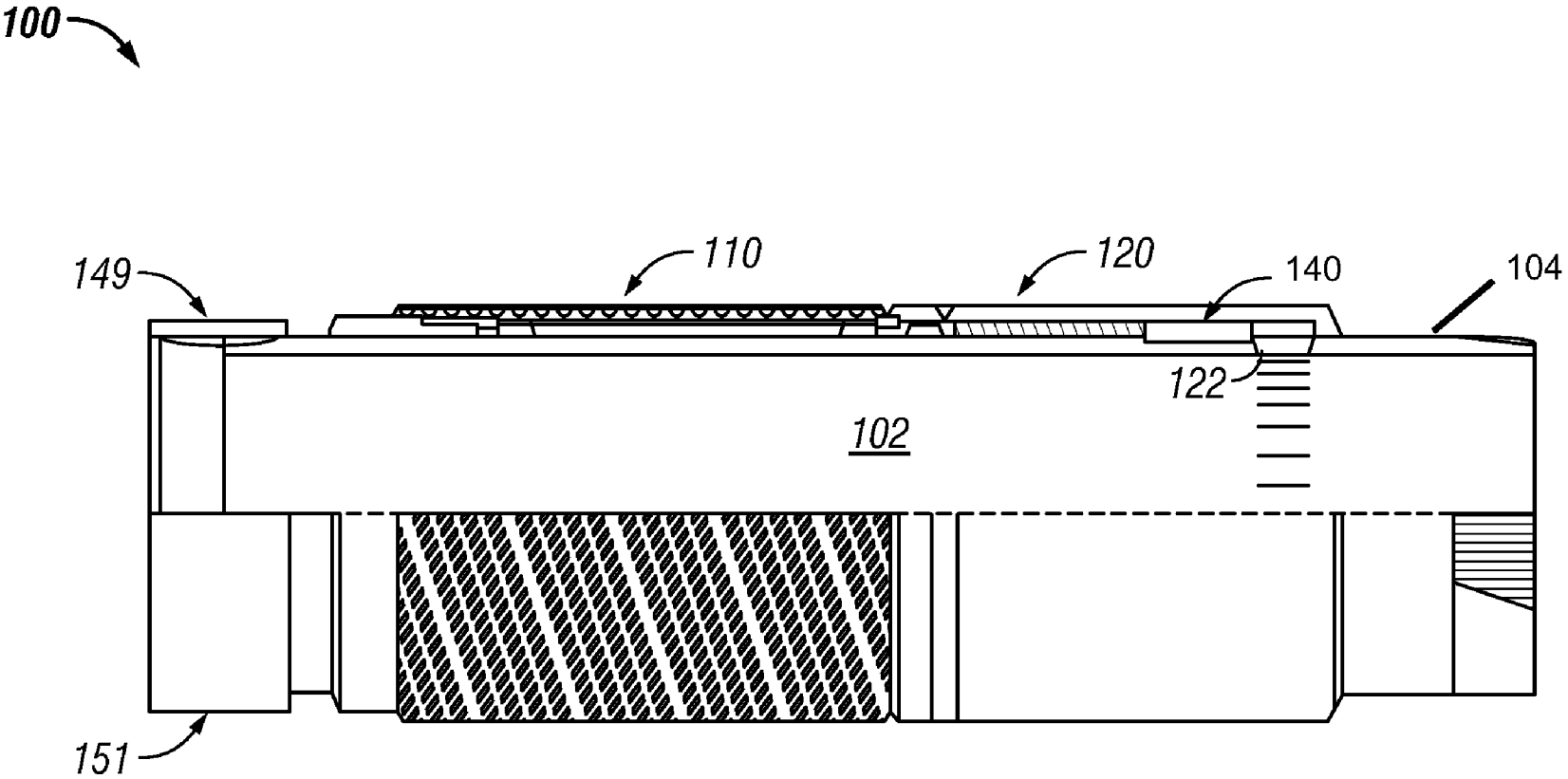
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids, an in-flow control device 120 that controls overall drainage rate from the formation, and a fluid in-flow control device 140 that controls in-flow area based upon the composition of the fluid in the production control device. The particulate control device 110 can include known devices such as sand screens and associated gravel packs and the in-flow control device 120 can utilize devices employing tortuous fluid paths designed to control inflow rate by created pressure drops. These devices have been previously discussed and are generally known in the art.

An exemplary in-flow control device 140 is adapted to control the in-flow area based upon the composition (e.g., oil, water, water concentration, etc) of the in-flowing fluid. Moreover, embodiments of the in-flow control device 140 are passive. By "passive," it is meant that the in-flow control device 140 controls in-flow area without human intervention, intelligent control, or an external power source. Illustrative human intervention includes the use of a work string to manipulate a sliding sleeve or actuate a valve. Illustrative intelligent control includes a control signal transmitted from a downhole or surface source that operates a device that opens or closes a flow path. Illustrative power sources include downhole batteries and conduits conveying pressurized hydraulic fluid or electrical power lines. Embodiments of the present disclosure are, therefore, self-contained, self-regulating and can function as intended without external inputs, other than interaction with the production fluid.

Figure 4:
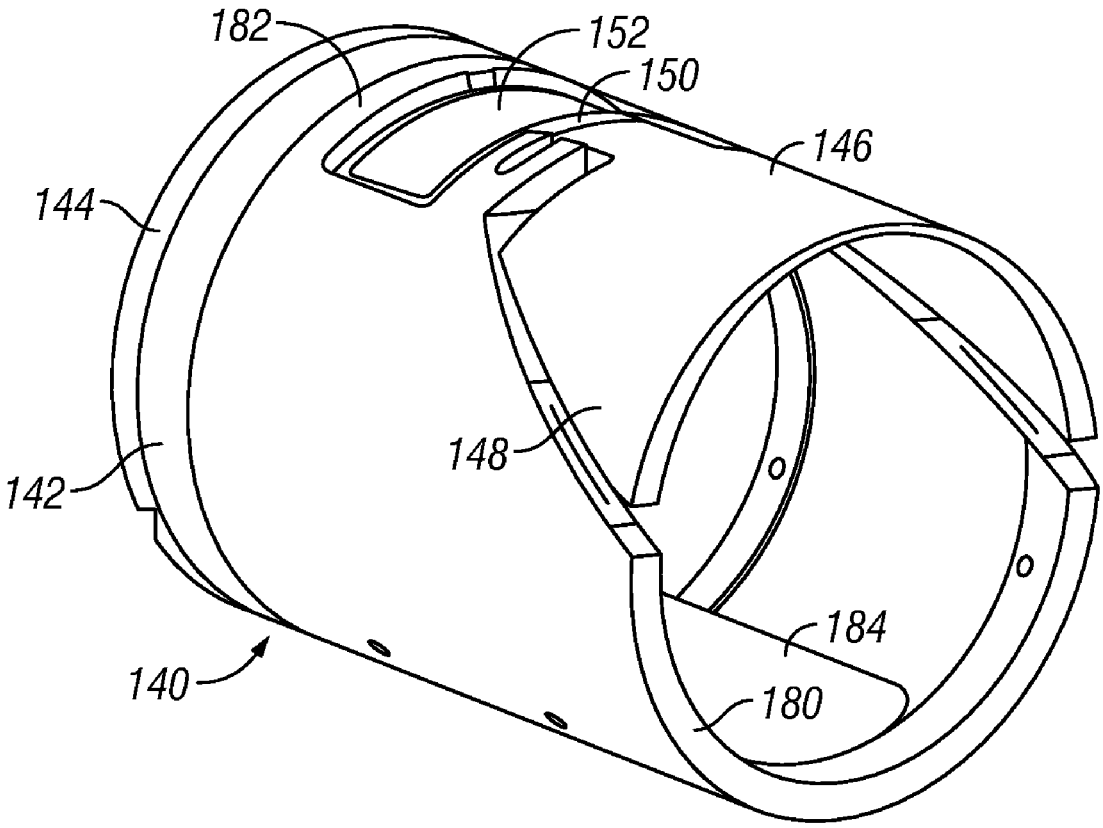
FIG. 4 is an isometric view of a in-flow control device made in accordance with one embodiment of the present disclosure.

Referring now to FIG. 4, there is shown one embodiment of an in-flow control device 140 that controls fluid in-flow based upon the composition of the in-flowing fluid. The in-flow control device 140 includes a seal 142, a body 144 and a flow restriction element 146. The term "flow restriction element," "closure element," "flapper," are used interchangeable to denote a member suited to blocking or obstructing the flow of a fluid in or to a conduit, passage or opening. The seal 142 prevents fluid flow through the annular flow area between the body 144 and an enclosing structure such as a housing (not shown) or even a wellbore tubular such as casing (not shown). Another seal (not shown) seals off the annular passage between the body 144 and the wellbore tubular 22 (FIG. 1). The body 144 is positioned on a pipe section (not shown) along a wellbore tubular string (not shown) and includes a passage 148 through which fluid must flow prior to entering a wellbore tubular such as the production assembly 22 (FIG. 1). The passage 148, while shown as slotted, can be of any suitable configuration. The flow restriction element 146 is adapted to restrict fluid flow into the passage 148. Restriction should be understood to mean a reduction in flow as well as completely blocking flow. The flow restriction element 146, in one arrangement, is coupled to the body 144 with a suitable hinge 150. Thus, the flow restriction element 146 rotates or swings between an open position wherein fluid can enter the passage 148 and a closed position wherein fluid is blocked from entering the passage 148. As explained earlier, fluid does not necessarily have to be completely blocked. For example, the flow restriction element 146 can include one or more channels (not shown) that allow a reduced amount of fluid to enter the passage 148 even when the flow restriction element 146 is in the closed position. A counter weight 152 may be used to assist the rotation of the flow restriction element 146 about the hinge 150.

The flow restriction element 146 moves from the open position to the closed position when the concentration of water, or water cut, increases to a predetermined level. As shown, the flow restriction element 146 is positioned on the "high side" 149 (FIG. 3) of the production string and is in an open position when the flowing fluid is oil and in a closed position when the flowing fluid is partially or wholly formed of water. In one arrangement, the flow restriction element 146 is formed partially or wholly out of a material that increases in density upon exposure to water. For instance, the flow restriction element 146 may have a first effective density less than oil when surrounded by oil and a second effective density greater than water when surrounded by water. Thus, the flow restriction element 146 "floats" in the oil to maintain an open position for the in-flow control device 140 and "sinks" in water to close the in-flow control device 140. Accordingly, the reaction of the flow restriction element 146 to the composition of the flowing fluid allows the flow restriction element 146 to passively control the fluid in-flow as a function of the composition of the fluid. In one aspect, the term "effective density" refers to density of the flow restriction element 146 as a unit. That is, the mass of the flow restriction element 146 as a whole may increase relative to its volume, which results in a greater effective density. The actual density of the components making up the flow restriction element 146, however, may not undergo a change in density. Illustrative embodiments of flow restriction elements are described below.

In one embodiment, the flow restriction element 146 is partially or wholly formed of a material that absorbs water. This absorption of water may cause the overall density of the flow restriction element 146 to shift from the first effective density less than oil to a second effective density greater than water.

Figure 5A:
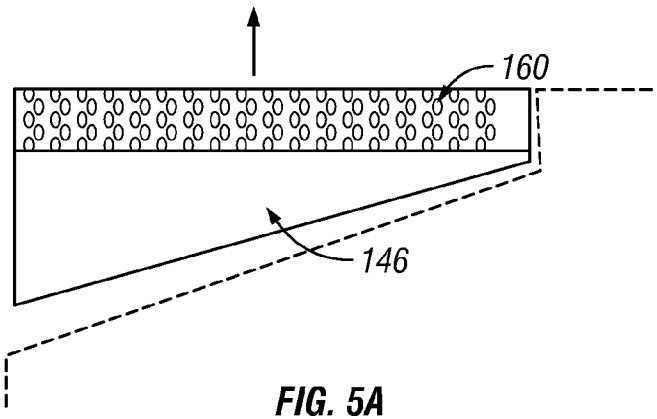
FIGS. 5A and 5B schematically illustrate one embodiment of an in-flow control device that utilizes a water absorbing material in accordance with the present disclosure.
Figure 5B:
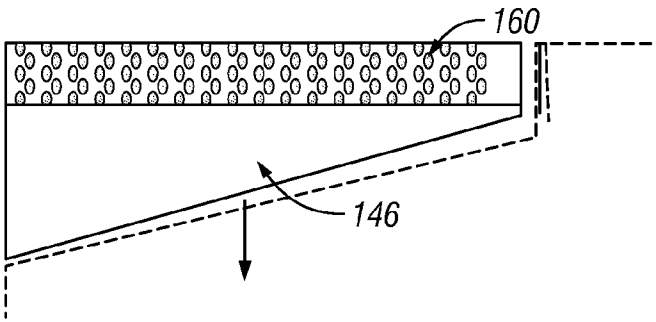

Referring now to FIGS. 5A and 5B, there is shown another embodiment wherein the flow restriction element 146 is formed of a material that has a density greater than water. The flow material element 146 is also formed partially or wholly of a material that has pores 160 that are water permeable but not oil permeable. As shown in FIG. 5A, the pores 160 of the flow restriction element 146 are initially filled with a relatively light fluid such as air. The relatively light fluid residing in the pores 160 cause the flow restriction element 146 to be positively buoyant in a substantially oil flow. As shown in FIG. 5B, as the water concentration increases, water molecules penetrate the pores 160 and displace the relatively light fluid. When a threshold value of the relatively light fluid has been displaced, the flow restriction element 146 becomes negatively buoyant and sinks to the closed position.

Figure 6A:
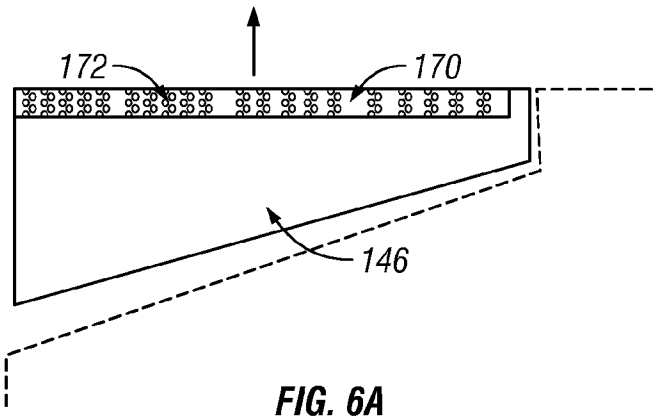
FIGS. 6A and 6B schematically illustrate one embodiment of an in-flow control device that utilizes a disintegrating material in accordance with the present disclosure.
Figure 6B:
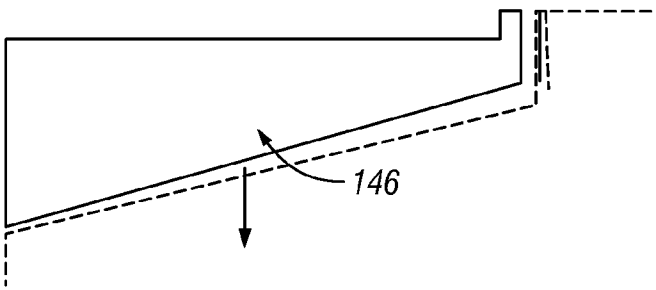

Referring now to FIGS. 6A and 6B, there is shown still another embodiment wherein the flow restriction element 146 is formed of a material that has a density greater than water. The flow material element 146 is also formed partially of a disintegrating material 170 that has entrained pores 172. As shown in FIG. 6A, the pores 172 of the disintegrating material 170 are filled with a relatively light fluid such as air. The relatively light fluid residing in the pores 172 cause the flow restriction element 146 to be positively buoyant in a substantially oil flow. The disintegrating material 170 is calibrated to dissolve, fracture, or otherwise lose structural integrity as the water cut increases in the flowing fluid and/or the water cut has reached a predetermined threshold. By calibrate or calibrated, it is meant that one or more characteristics relating to the capacity of the element to disintegrate is intentionally tuned or adjusted to occur in a predetermined manner or in response to a predetermined condition or set of conditions. For example, the disintegrating material 170 may be formed of a water soluble metal that reacts and disintegrates when exposed to water. In other embodiments, the disintegrating material 170 may be configured to maintain structural integrity when surrounded in oil, but lose structural integrity as oil concentration drops. As shown in FIG. 6B, as the water concentration increases or oil concentration decreases, the disintegrating material 170 disintegrates. Because the pores 172 are no longer present, the flow restriction element 146 becomes negatively buoyant and sinks to the closed position. In one aspect, it should be appreciated that the loss of the disintegrating material 170 has increased the effective density of the flow restriction element 146.

It will be appreciated that an in-flow control device 140 utilizing a density sensitive flow restriction member is amenable to numerous variations. For example, referring now to FIG. 6A, the flow restriction element 146 can be positioned on the "low side" 151 (FIG. 3) of the production string. In one variant, the density of the material forming the flow restriction element 146 can be selected to be less than the density of water and of oil. The disintegrating material 170 is entrained with relatively heavy elements that cause the flow restriction element 146 to have an effective density that is greater than oil. Thus, the flow restriction element 146 sinks to an open position when surrounded by oil. As the water concentration increases or oil concentration decreases, the disintegrating material 170 disintegrates. Because the relatively heavy elements are no longer present, the flow restriction element 146 becomes positively buoyant and floats to the closed position. Accordingly, the flow restriction element 146 "sinks" to an open position when in oil and "floats" to a closed position when in water.

It should be appreciated that, for the purposes of the present disclosure, the counter weight may be considered a part of the flow restriction element 146. Thus, the water absorbing or disintegrating material may be integrated into the counter weight as part of the mechanism to move the flow restriction element 146.

In some embodiments, the in-flow control device 140 can be installed in the wellbore in a manner that ensures that the flow restriction element 146 is immediately in the high side position. In other embodiments, the in-flow control device 140 can be configured to automatically align or orient itself such that the flow restriction element 146 moves into the high side position regardless of the initial position of the in-flow control device 140. Referring now to FIG. 4, for example, the body 144, which is adapted to freely rotate or spin around the wellbore tubular 22 (FIG. 1), can be configured to have a bottom portion 180 that is heavier than a top portion 182, the top portion 182 and bottom portion 180 forming a gravity activated orienting member or gravity ring. The flow restriction element 146 is coupled to the top portion 182. Thus, upon installation in the wellbore, the bottom portion 180 will rotate into a low side position 151 (FIG. 3) in the wellbore, which of course will position the flow restriction element 146 on the high side 149 (FIG. 3) of the wellbore. The weight differential between the top portion and the bottom portion 148 can be caused by adding weights 184 to the bottom portion 148 or removing weight from the top portion 180. In other embodiments, human intervention can be utilized to appropriately position the in-flow control device 140 or a downhole motor, e.g., hydraulic or electric, can be used to position the in-flow control device 140 in a desired alignment.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow those and other wellbore tubulars.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a formation fluid into a wellbore tubular in a wellbore, comprising:

a flow restriction member positioned along the wellbore tubular, the flow restriction member being configured to transition from a first effective density to a second effective density in response to a change in composition of the flowing formation fluid, wherein the effective density change causes movement of the flow restriction member due to gravity.

2. The apparatus according to claim 1 wherein the flow restriction member is formed of a water-absorbing material, the flow restriction member increasing in density as water is absorbed.

3. The apparatus according to claim 1 wherein the flow restriction member is formed at least partially of a material that is calibrated to disintegrate when exposed to a selected fluid in the flowing fluid.

4. The apparatus according to claim 1 wherein the flow restriction member is formed at least partially of a material that has pores.

5. The apparatus according to claim 4 wherein the pores are water permeable but not oil permeable.

6. The apparatus according to claim 1, wherein the flow restriction member is configured to increase in effective density as a percentage of water in the flowing fluid increases.

7. The apparatus according to claim 1 wherein the flow restriction member is configured to one of: (i) sink in the formation fluid; and (ii) float in the formation fluid.

8. A method for producing fluid from a subterranean formation, comprising:

(a) controlling a flow of fluid into a wellbore tubular with a flow restriction member, wherein an effective density of the flow restriction element is caused by a change in composition of the flowing fluid from the subterranean formation, the flow restriction element moving due to gravity.

9. The method according to claim 8, wherein the flow restriction member is configured to increase in effective density as a percentage of water in the flowing fluid increases.

10. The method according to claim 8, further comprising reducing a flow of water into the wellbore tubular when a percentage of water in the flowing fluid reaches a predetermined value.

11. The method according to claim 8 further comprising increasing the density of the flow restriction member by absorbing water into the flow restriction member.

12. The method according to claim 8 wherein the flow restriction member is formed at least partially of a material that disintegrates when exposed to a selected fluid in the flowing fluid.

13. The method according to claim 8 wherein the flow restriction member is formed at least partially of a material that has pores calibrated to be permeable by a selected fluid.

14. The method according to claim 13 wherein the pores are water permeable but not oil permeable.

15. A system for controlling a flow of a fluid in a well, comprising:

a wellbore tubular positioned in the well, the wellbore tubular being configured to convey fluid in a bore of the wellbore tubular;

at least one flow restriction member positioned along the wellbore tubular, the flow restriction member being configured to transition from a first effective density to a second effective density in response to a change in composition of the flowing formation fluid, wherein the effective density change causes movement of the flow restriction member due to gravity.

16. The system according to claim 15 wherein the first effective density is less than the second effective density.

17. The system according to claim 15, wherein the flow restriction member is configured to increase in effective density as a percentage of water in the flowing fluid increases.

18. The system according to claim 15 wherein the flow restriction member is formed at least partially of a material that disintegrates in response to the change in composition of the flowing fluid.

19. The system according to claim 15 wherein the at least one flow restriction member includes a plurality of flow restriction members distributed along the wellbore tubular.

20. The system according to claim 15 wherein the flow restriction member is configured to decrease the flow of the fluid in the wellbore tubular when a percentage of water in the flowing fluid reaches a predetermined value.

* * * * *